US008973712B2

(12) United States Patent
Uhl et al.

(10) Patent No.: US 8,973,712 B2
(45) Date of Patent: Mar. 10, 2015

(54) INGROUND SUPERSTRUCTURE AND INTEGRATED THIRD STAGE ARM FOR VEHICLE LIFT

(75) Inventors: John E. Uhl, Madison, IN (US); Kevin A. Brittain, Madison, IN (US); Keith W. Siddall, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 692 days.

(21) Appl. No.: 13/025,769

(22) Filed: Feb. 11, 2011

(65) Prior Publication Data

US 2011/0198156 A1 Aug. 18, 2011

Related U.S. Application Data

(60) Provisional application No. 61/303,994, filed on Feb. 12, 2010.

(51) Int. Cl.
*B66F 7/10* (2006.01)
*B66F 7/28* (2006.01)
*B66F 7/16* (2006.01)

(52) U.S. Cl.
CPC .... *B66F 7/28* (2013.01); *B66F 7/16* (2013.01)
USPC ..... 187/219; 254/93 L; 187/220

(58) Field of Classification Search
USPC ..... 187/218–220; 254/93 L, 93 H, 89 H, 95
See application file for complete search history.

(56) References Cited

U.S. PATENT DOCUMENTS

| | | | |
|---|---|---|---|
| 942,755 | A | 12/1909 | Schollmeyer |
| 1,055,099 | A | 3/1913 | Sullivan |
| 1,870,128 | A | 8/1932 | Lunati |
| 1,889,185 | A | 11/1932 | Stukenborg |
| 1,899,534 | A | 2/1933 | Steedman |
| 1,915,024 | A | 6/1933 | Logette et al. |

(Continued)

FOREIGN PATENT DOCUMENTS

| | | |
|---|---|---|
| DE | 1 209 268 | 1/1966 |
| DE | 4 028 484 | 3/1992 |

(Continued)

OTHER PUBLICATIONS

International Search Report dated Apr. 6, 2011 for Application No. PCT/US2011/024494.

(Continued)

*Primary Examiner* — William E Dondero
*Assistant Examiner* — Diem Tran
(74) *Attorney, Agent, or Firm* — Frost Brown Todd LLC

(57) ABSTRACT

A vehicle lift includes a carrier and a pair of arms. The arms comprise a pair of segments and an adapter pilot slidably disposed in one of the arm segments. The arm segments are slidable relative to each other and define slots to accommodate sliding of the adapter, providing various positions for the adapter along the length collectively defined by the arm segments. The adapter pilot is configured to receive an adapter to engage a vehicle. The arms are pivotable relative to the carrier and present a low profile to provide clearance for low vehicles. The carrier comprises a low profile superstructure. The superstructure includes a pair of substantially horizontal plates with substantially vertical web members extending between the substantially horizontal plates. The superstructure further includes a yoke portion pivotally coupled with the arms.

18 Claims, 15 Drawing Sheets

(56) References Cited

U.S. PATENT DOCUMENTS

| | | | | | |
|---|---|---|---|---|---|
| 1,919,156 | A | | 7/1933 | Banning, Jr. | |
| 1,985,510 | A | | 12/1934 | Lunati | |
| 2,640,977 | A | | 6/1953 | Parisi | |
| 2,844,218 | A | | 7/1958 | Hott | |
| 2,956,581 | A | | 10/1960 | Pearson | |
| 3,061,044 | A | | 10/1962 | Shotmeyer | |
| 3,237,723 | A | * | 3/1966 | Halstead | 187/219 |
| 3,279,562 | A | | 10/1966 | Farrell | |
| 3,331,470 | A | | 7/1967 | Hott | |
| 3,334,706 | A | | 8/1967 | Dayson | |
| 3,415,342 | A | | 12/1968 | Hott | |
| 3,489,248 | A | | 1/1970 | Clarke | |
| 3,775,026 | A | | 11/1973 | Hewlings | |
| 3,892,292 | A | | 7/1975 | Takenoshita et al. | |
| 3,981,619 | A | | 9/1976 | Mitter | |
| 4,022,428 | A | | 5/1977 | Mantha | |
| 4,452,340 | A | | 6/1984 | Hernick et al. | |
| 4,679,660 | A | * | 7/1987 | Suzuki | 187/219 |
| 4,687,078 | A | | 8/1987 | Wilson | |
| 4,700,748 | A | | 10/1987 | Fossati et al. | |
| 4,726,450 | A | | 2/1988 | Fossati et al. | |
| 4,763,761 | A | | 8/1988 | McKinsey et al. | |
| 4,825,977 | A | * | 5/1989 | Isogai | 187/206 |
| 4,830,146 | A | | 5/1989 | Nakamura et al. | |
| 4,830,147 | A | | 5/1989 | Kawada | |
| 4,848,732 | A | | 7/1989 | Rossato | |
| 5,014,824 | A | | 5/1991 | Fargo | |
| 5,050,844 | A | | 9/1991 | Hawk | |
| 5,096,159 | A | | 3/1992 | Fletcher | |
| 5,099,956 | A | | 3/1992 | Curran | |
| 5,143,179 | A | | 9/1992 | Hornstein | |
| 5,190,122 | A | | 3/1993 | Fletcher et al. | |
| 5,199,686 | A | | 4/1993 | Fletcher | |
| 5,259,482 | A | | 11/1993 | Proulx et al. | |
| D343,488 | S | | 1/1994 | Fletcher | |
| 5,299,658 | A | | 4/1994 | Cox et al. | |
| 5,322,143 | A | | 6/1994 | Curran | |
| 5,404,968 | A | | 4/1995 | Fletcher | |
| 5,501,296 | A | | 3/1996 | Fletcher | |
| 5,501,299 | A | | 3/1996 | Holmes | |
| 5,518,220 | A | | 5/1996 | Bertrand et al. | |
| 5,573,083 | A | | 11/1996 | Fletcher et al. | |
| 5,678,253 | A | | 10/1997 | Baker | |
| 5,709,286 | A | | 1/1998 | Mead et al. | |
| 5,740,886 | A | | 4/1998 | Fletcher | |
| 5,969,619 | A | | 10/1999 | Niemiro et al. | |
| 6,244,390 | B1 | | 6/2001 | Yeo et al. | |
| 6,571,919 | B1 | | 6/2003 | Stewart | |
| 6,814,187 | B2 | | 11/2004 | Brown et al. | |

FOREIGN PATENT DOCUMENTS

| | | |
|---|---|---|
| FR | 1 279 190 | 12/1961 |
| GB | 1 072 375 | 6/1967 |
| WO | WO 96/31292 | 10/1996 |

OTHER PUBLICATIONS

Written Opinion dated Apr. 6, 2011 for Application No. PCT/US2011/024494.

* cited by examiner

INGROUND SUPERSTRUCTURE AND INTEGRATED THIRD STAGE ARM FOR VEHICLE LIFT

PRIORITY

This application claims priority to U.S. Provisional Patent Application Ser. No. 61/303,994, entitled "Superstructures and Arms for In-Ground Vehicle Lift," filed Feb. 12, 2010, the disclosure of which is incorporated by reference herein.

BACKGROUND

A variety of automotive lift systems have been made and used over the years in a variety of contexts. Some types of automotive lifts are installed in-ground while other types are installed above-ground. In some in-ground lifts, one or more posts are selectively retractable/extendable relative to the ground to raise/lower a vehicle relative to the ground. For instance, a single post may be positioned under the center of the vehicle. Alternatively, one post may be positioned at one side of the vehicle while another post is positioned at the opposite side of the vehicle. Such one or more posts may include superstructures that are capable of engaging the vehicle. Such superstructures may be mounted to the tops of the posts, such that the superstructure is raised/lowered relative to the ground as the one or more posts are retracted/extended relative to the ground. Such superstructures may include a yoke with one or more arms movably mounted thereto. For instance, a yoke may have a pair of arms that are movable relative to the yoke to selectively position the arms relative to the yoke. Each arm may have a member that is configured to engage the vehicle.

Examples of automotive lifts and associated components are disclosed in U.S. Pat. No. 5,740,886, entitled "Method of Retrofit of In-Ground Automotive Lift System," issued Apr. 21, 1998, the disclosure of which is incorporated by reference herein; U.S. Pat. No. 6,571,919, entitled "Removable Cylinder Arrangement for Lift," issued Jun. 3, 2003, the disclosure of which is incorporated by reference herein; and U.S. Pat. No. 6,814,187, entitled "System for Detecting Liquid in an Inground Lift," issued Nov. 9, 2004, the disclosure of which is incorporated by reference herein.

While a variety of automotive lift systems have been made and used, it is believed that no one prior to the inventors has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
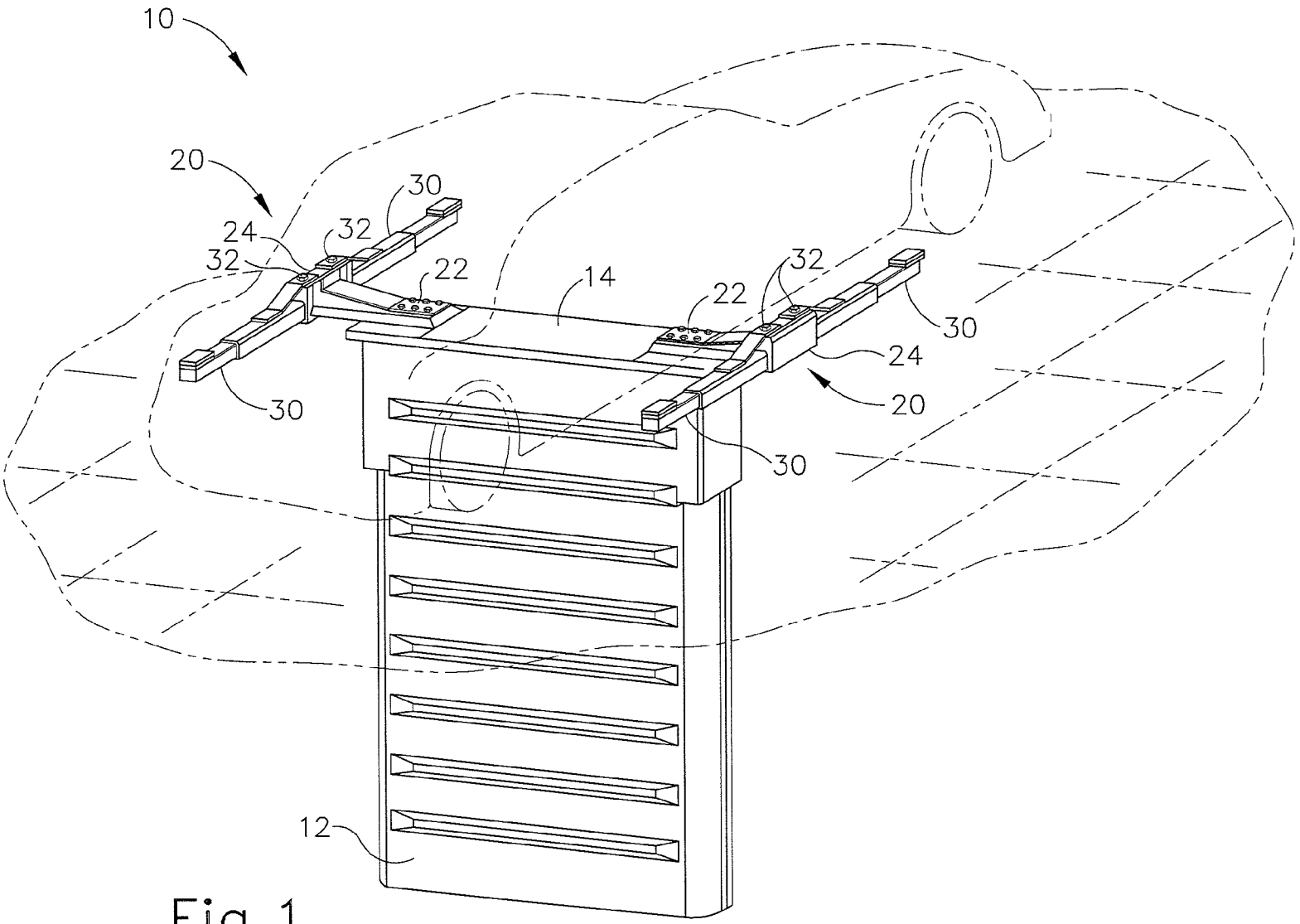
FIG. 1 depicts a perspective view of an exemplary vehicle lift system, with its posts retracted relative to the ground.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Overview

Figure 2:
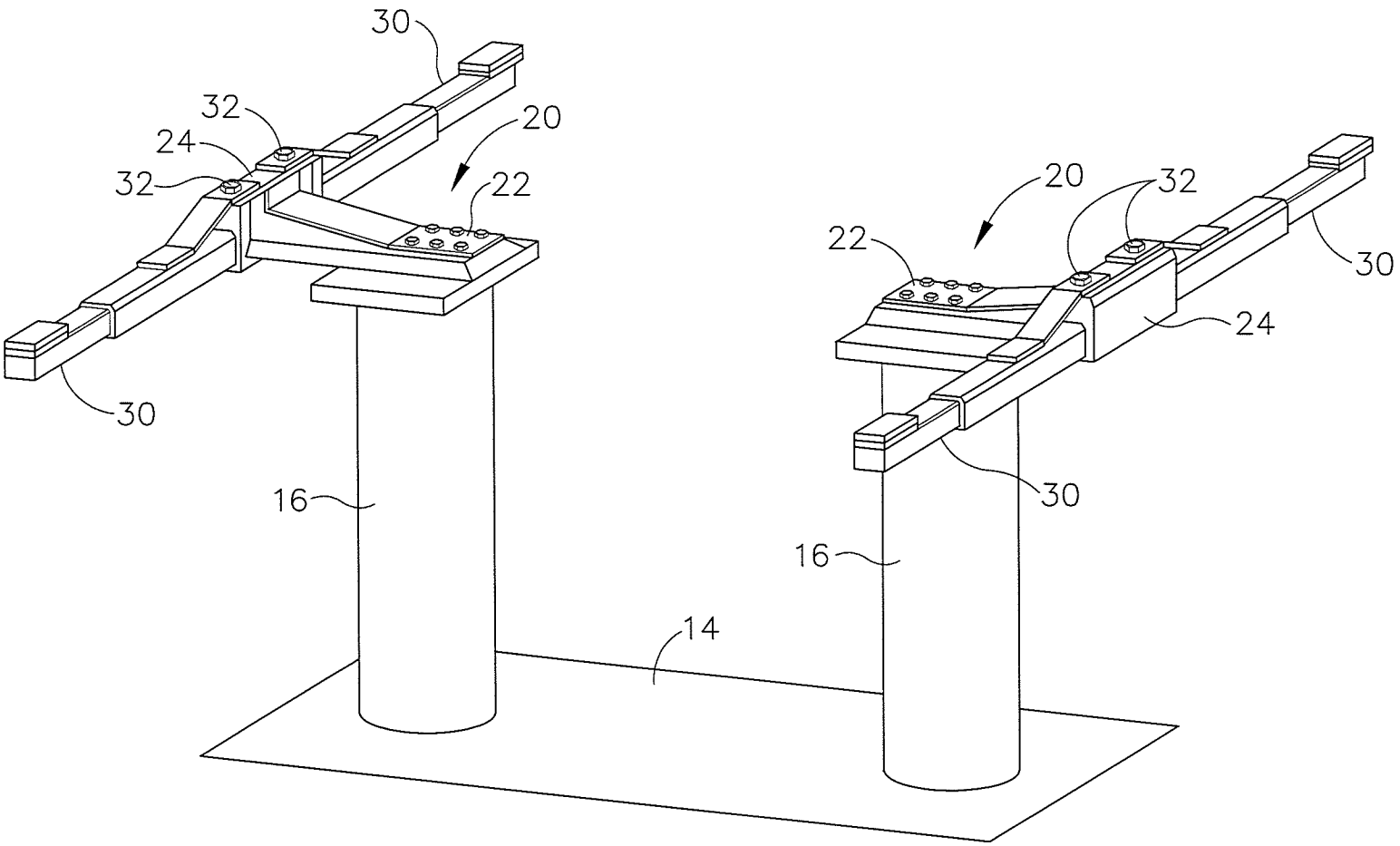
FIG. 2 depicts a perspective view of the vehicle lift system of FIG. 1, with its posts extended relative to the ground.
Figure 3:
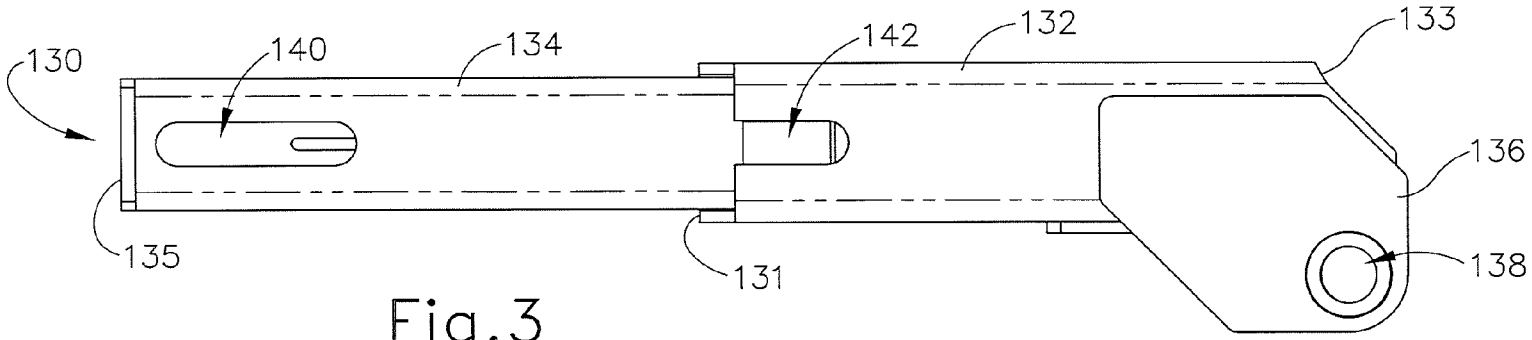
FIG. 3 depicts a top plan view of an exemplary alternative first arm that may be used with the vehicle lift system of FIG. 1.

FIGS. 1-2 illustrate an exemplary lift (10). Lift (10) of the present example comprises a housing (12) that extends beneath the level of ground (e.g., shop floor, etc.), a base plate (14) that is fixedly positioned at about the level of ground, and a pair of posts (16) that extend or retract relative to the level of ground. For instance, FIG. 1 shows posts (16) retracted into the ground while FIG. 2 shows posts (16) extended relative to the ground. A superstructure (20) is fixedly mounted to the top of each post (16). Each superstructure (20) comprises a base portion (22), which is bolted or otherwise secured to the top of each post (16), and a yoke portion (24), which is integral with base portion (22). Each yoke portion (24) is associated with a respective pair of arms (30), which are pivotally secured to their corresponding yoke portion (24). In particular, each arm (30) is joined to its corresponding yoke portion (24) by a pin (32). Each arm (30) is rotatable about the longitudinal axis defined by its corresponding pin (32).

Arms (30) are configured to engage a vehicle, and may be selectively positioned to engage a particular vehicle at particular lift points associated with the particular vehicle. For instance, with posts (16) retracted in the ground, arms (30) may be initially positioned outward as shown in FIG. 1. The vehicle may then drive to position over base plate (14) (e.g., such that the length of the vehicle is substantially centered over base plate (14)). The vehicle may need to drive over base portions (22) of superstructures (20) at this stage. For instance, the vehicle's wheels may ride directly over base portions (22). With the vehicle suitably positioned relative to lift (10), arms (30) may be rotated inwardly about pins (32) to locate the free ends of arms (30) at lift point positions underneath the vehicle. With arms (30) at appropriate positions, posts (16) may be extended relative to the ground. With arms (30) being engaged with the vehicle at the selected lift points, and with arms (30) being engaged with posts (16) via superstructures (20), such extension of posts (16) will raise the vehicle relative to the ground.

FIGS. 3-16 depict alternative arms (130, 230) and an alternative superstructure (300) that may be used with lift (10). In particular, superstructure (300) may be secured to the tops of posts (16) by bolts and/or in any other suitable fashion. Arms (130, 230) may be pivotally secured to superstructure (300) by pins (32) and/or in any other suitable fashion. It should be understood that arms (130, 230) may alternatively be pivotally secured to superstructure (20) or any other suitable type of structure. Similarly, arms (30) or any other suitable structure may be pivotally secured to superstructure (300). Numerous variations and alternative combinations will be apparent to those of ordinary skill in the art in view of the teachings herein. Arms (130, 230) of the present example and superstructure (300) of the present example will be described in greater detail below.

II. Exemplary Arms

Figure 6:
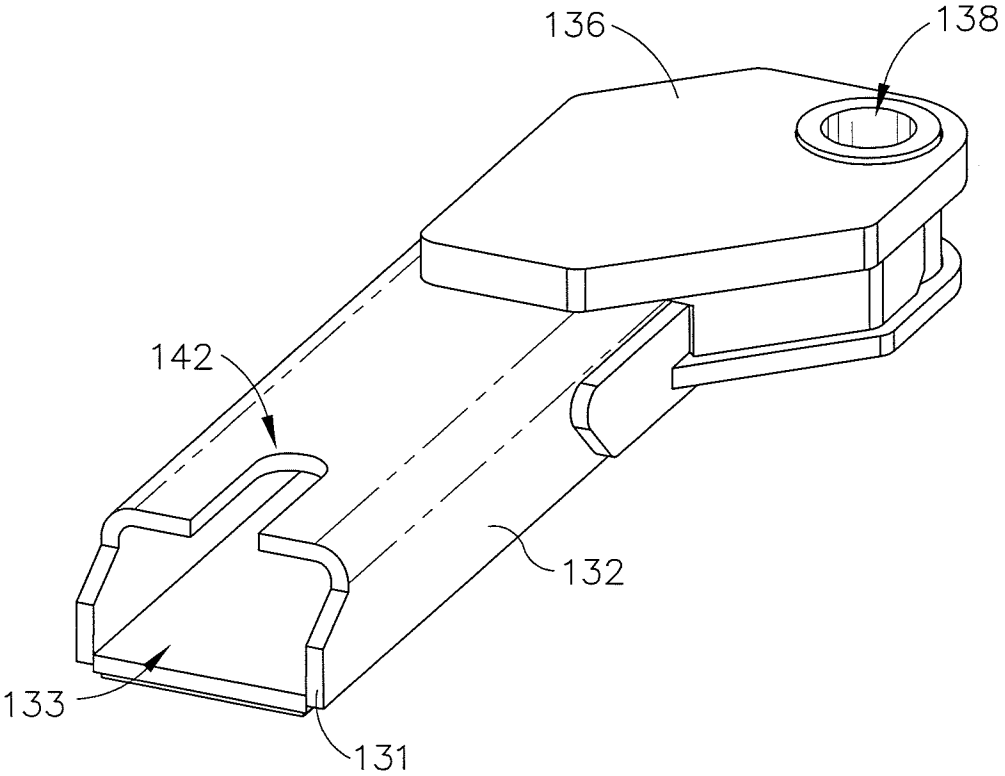
FIG. 6 depicts a top perspective view of a first segment of the first arm of FIG. 3.
Figure 7:
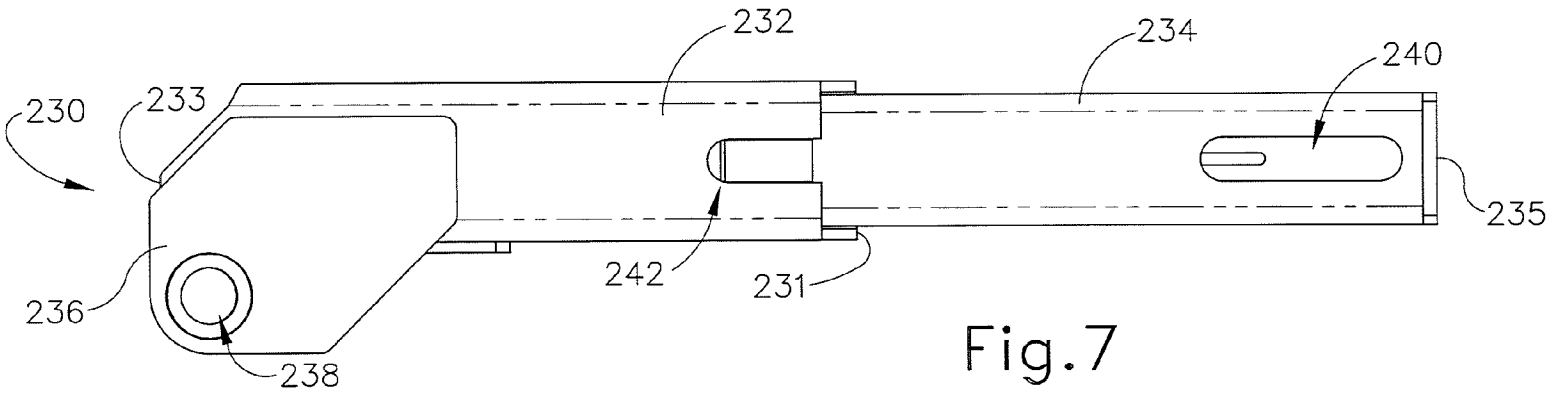
FIG. 7 depicts a top plan view of an exemplary alternative second arm that may be used with the vehicle lift system of FIG. 1.

FIGS. 3-6 show first arm (130) of the present example. First arm (130) comprises a first segment (132) and a second segment (134). First segment (132) has a distal end (131) and a proximal end (133). Second segment (134) has a distal end (135) and a proximal end (not shown). Second segment (134) telescopically extends from first segment (132), such that the effective length of first arm (130) may be selectively varied. In particular, and as shown in FIG. 6, first segment (132) defines a hollow interior (133) that is configured to receive second segment (134). In FIGS. 3-6, second segment (134) is shown in an extended position where the proximal end of second segment (134) is located within first segment (132). In some versions, second segment (134) may be retracted relative to first segment (132) to such a degree that the proximal end of second segment (134) protrudes proximally from proximal end (133) of first segment (132). First arm (130) may further be configured such that the longitudinal position of second segment (134) relative to first segment (132) may be selectively locked once second segment (134) has been translated relative to first segment (132) to a desired longitudinal position. Various suitable ways in which such selective locking may be provided will be apparent to those of ordinary skill in the art in view of the teachings herein. In some versions, a locking mechanism or feature is omitted. For instance, in some versions, friction may substantially maintain an adjusted longitudinal positioning of second segment (134) relative to first segment (132). In other words, the mass and/or other properties of segments (132, 134) may permit a user to slide second segment (134) relative to first segment (132) to achieve an adjusted positioning; for the user to then release second segment (134); and for second segment (134) to substantially remain in the adjusted position until the user again manipulates second segment (134) for further adjustment.

First segment (132) of the present example also includes a mounting portion (136). Mounting portion (136) provides a coupling with superstructure (300) as will be described in greater detail below. Mounting portion (136) includes a pair of aligned openings (138), which are configured to receive a pin (32) to provide pivoting coupling of first arm (130) with superstructure (300).

Second segment (134) is hollow and has an adapter pilot (400) slidingly disposed therein. As shown in FIGS. 17A-18B, adapter pilot (400) of the present example includes a lower flange (410), an upwardly extending outer sidewall (420), and an upwardly extending inner sidewall (424). An opening (422) is formed through sidewalls (420, 424) and is configured to receive a pin (426) Inner sidewall (424) defines a bore (428) configured to receive part of an accessory. For instance, a support pad adapter (500) is an exemplary accessory shown in FIGS. 17A-17B that may be used with adapter pilot (400). Support pad adapter (500) of this example includes an upper plate (510) with a support pad (512) thereon, and a shaft (520) extending downwardly from upper plate (510). Shaft (520) is insertingly received within bore (428) defined by inner sidewall (424). In some versions, adapter pilot (400) and/or support pad adapter (500) are configured such that one or more thread-up adapters and/or stackable inserts may be used to increase the vertical distance between upper plate (150) and lower flange (410), thereby selectively increasing the effective height of the assembly shown in FIG. 17B. It should be understood that, when each arm (130, 230) of a lift (10) has a respective support pad adapter (500), a vehicle that is raised and lowered by lift (10) may be held by support pads (512), which contact appropriate lift points at the underside of the vehicle.

Figure 18A:
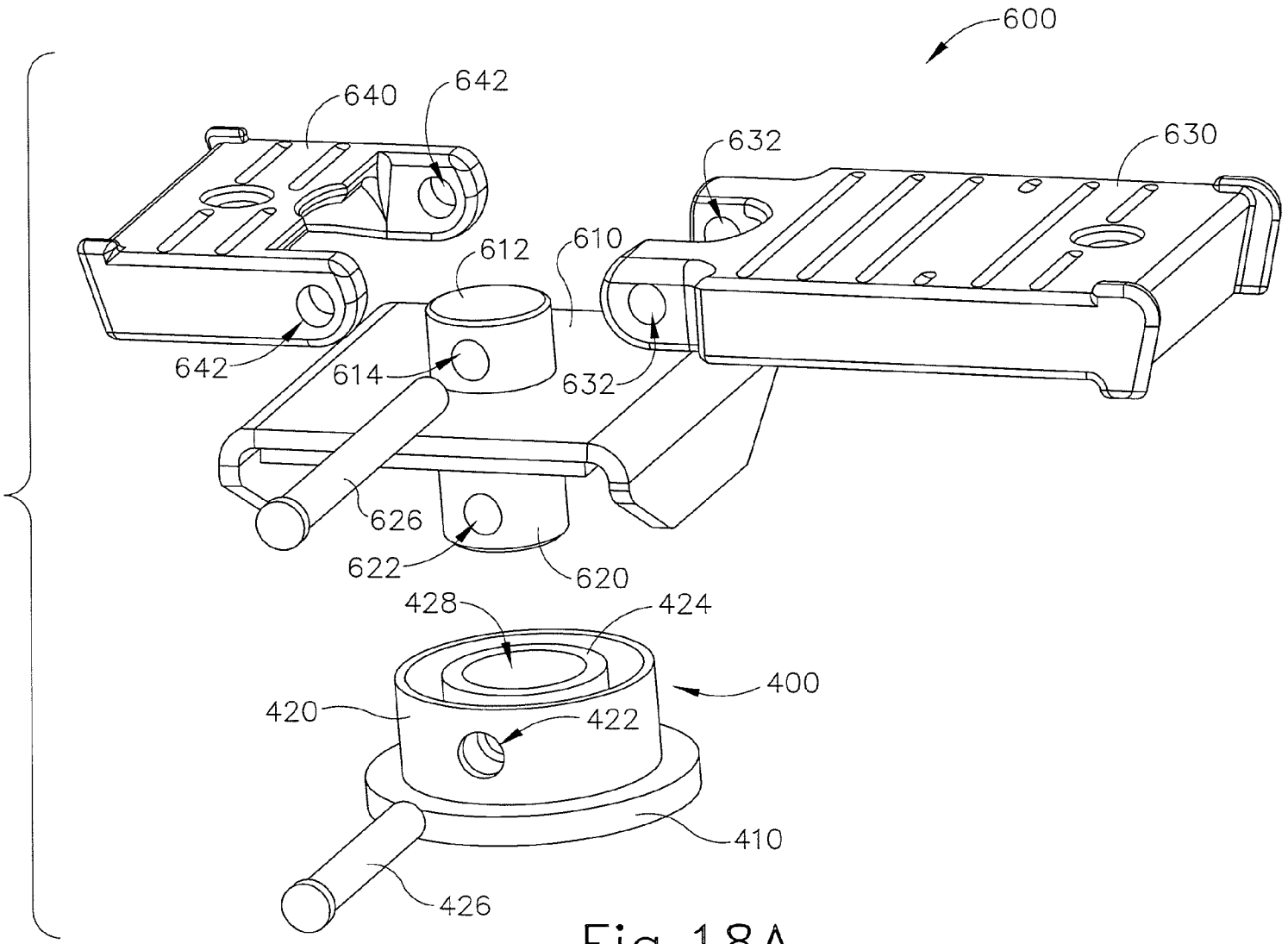
FIG. 18A depicts a perspective view of the adapter pilot of FIG. 17A with an exploded flip-up adapter separated from the adapter pilot.
Figure 18B:
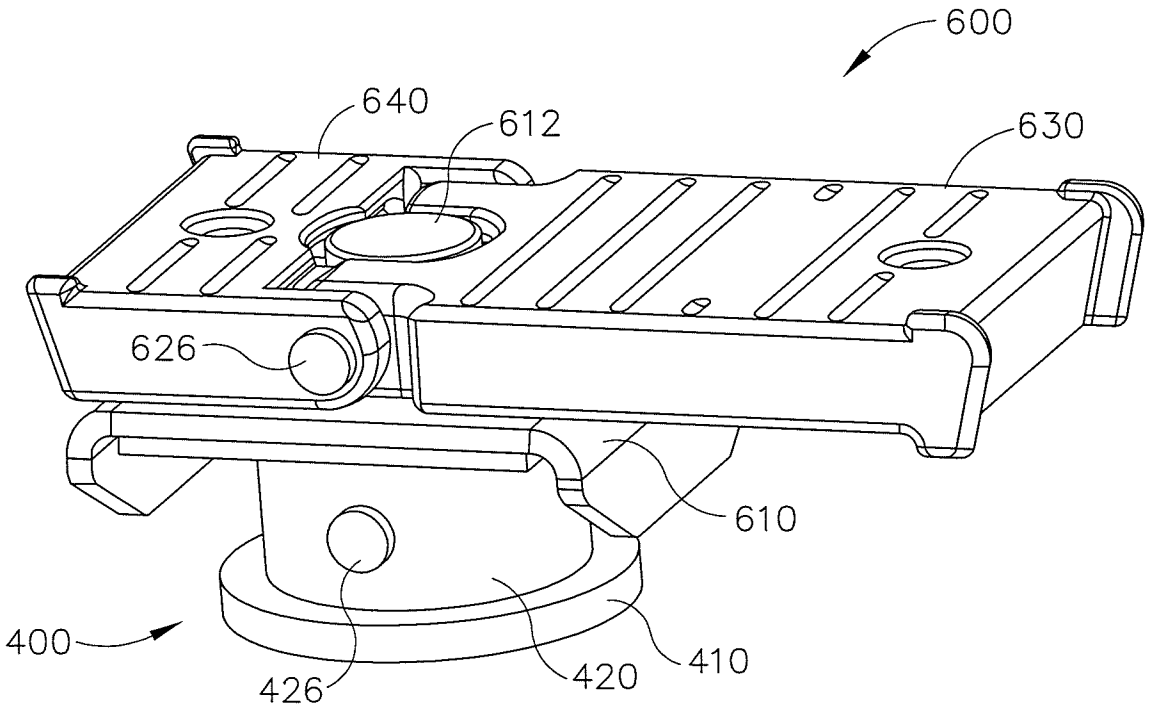
FIG. 18B depicts a perspective view of the adapter pilot and flip-up adapter of FIG. 18A with the flip-up adapter assembled and with the adapter pilot and flip-up adapter coupled together.

A flip-up adapter (600) is an exemplary accessory shown in FIGS. 18A-18B that may be used with adapter pilot (400). Flip-up adapter (600) of this example includes a central flange (610) with an upper shaft (612) extending upwardly therefrom and a lower shaft (620) extending downwardly therefrom. Shaft (620) includes an opening (622) that aligns with openings (422) of adapter pilot (400) when shaft (620) is inserted in bore (428) of adapter pilot (400). A pin (426) may then be inserted through aligned openings (422, 622) to secure flip-up adapter (600) to adapter pilot (400). Flip-up adapter (600) also includes a long arm (630) and a short arm (640). Long arm (630) includes a pair of aligned openings (632). Short arm (640) also includes a pair of aligned openings (642). Arms (630, 640) are configured such that all of openings (632, 642) may be aligned with an opening (614) formed through upper shaft (612), such that a pin (626) may be inserted in all of openings (614, 632, 642) to pivotally secure arms (630, 640) relative to central flange (610). It should be understood that, when each arm (130, 230) of a lift (10) has a respective flip-up adapter (600), a vehicle that is raised and lowered by lift (10) may be held by one or both of arms (630, 640), which contact(s) appropriate lift points at the underside of the vehicle. For instance, in a first configuration both arms (630, 640) are substantially horizontal when flip-up adapter (600) supports a vehicle. In a second configuration long arm (630) is pivoted to a vertical position while short arm (640) remains in a horizontal position, such that long arm (630) supports the vehicle. In a third configuration short arm (640) is pivoted to a vertical position while long arm (630) remains in a horizontal position, such that short arm (640) supports the vehicle. Of course, it should be understood that any other suitable type of accessory may be used with accessory pilot (400), that any suitable adapters may be used with various kinds of accessories, and that various kinds of accessories/adapters may be used in combination with each other. It should also be understood that various kinds of accessories may be rotatable relative to accessory pilot (400) to further facilitate desired positioning of such accessories.

Referring back to FIG. 3, second segment (134) of first arm (130) further includes a slot (140). First segment (132) also includes a slot (142), which is substantially aligned with slot (140). Slots (140, 142) facilitate selective positioning of adapter pilot (400) along the length of first arm (130) (and in some cases along the length of second arm (132) as well). In the present example, when adapter pilot (400) is disposed in first arm (130), lower flange (410) is positioned within the hollow interior defined by second segment (134) while an accessory (500, 600) that is secured to adapter pilot (400) is positioned above the top surface of second segment (134), with shaft (520, 620) of accessory (500, 600) passing through slot (140). With accessory (500, 600) being exposed above second segment (134), accessory (500, 600) may be used to directly contact a vehicle for raising the vehicle. As noted above, adapter pilot (400) resides within second segment (134) in some versions and receives various types of accessories based on an operator's selection, without adapter pilot (400) having to necessarily be removed from second segment (134).

Upwardly extending outer sidewall (420) of adapter pilot (400) and slot (140) of first arm (130) are sized and configured such that accessory (500, 600) may be translated to various positions along the length of slot (140). Such translatability of adapter pilot (400) relative to the length of second segment (134) thus provides flexibility in placing accessory (500, 600) at a desired lift point under a vehicle. In other words, the translatability of adapter pilot (400) relative to the length of second segment (134) facilitates use of lift (10) with various types of vehicles that are of various sizes. In some versions, an adjusted position of adapter pilot (400) may be selectively locked relative to second segment (134). Various suitable ways in which such selective locking may be provided will be apparent to those of ordinary skill in the art in view of the teachings herein. In some versions, a locking mechanism or feature is omitted. For instance, in some versions, friction may substantially maintain an adjusted longitudinal positioning of adapter pilot (400) relative to second segment (134). In other words, the mass and/or other properties of adapter pilot (400) and second segment (134) may permit a user to slide adapter pilot (400) relative to second segment (134) to achieve an adjusted positioning; for the user to then release adapter pilot (400); and for adapter pilot (400) to substantially remain in the adjusted position until the user again manipulates adapter pilot (400) for further adjustment.

It should also be understood that the translatability of second segment (134) relative to first segment (132) may facilitate use of lift (10) with various types of vehicles that are of various sizes, as such translation of second segment (134) relative to first segment (132) provides even more available positions for accessory (500, 600) underneath a vehicle. Furthermore, the presence and configuration of slot (142) provides additional clearance for shaft (520, 620) of accessory (500, 600) in settings where second segment (134) is substantially retracted relative to first segment (132) (e.g., where a common vertical axis passes through both slots (140, 142), and where the proximal end of second segment (134) is protruding outwardly relative to proximal end (133) of first segment (132), etc.). In the absence of slot (142), the retractability of second segment (134) relative to first segment (132) may be relatively restricted to a greater degree, as first segment (132) would engage shaft (520, 620) of accessory (500, 600) relatively sooner as second segment (134) is retracted into first segment (132). In the present example, second segment (134) is longer than a conventional second segment yet has at least the same degree of extension and retraction as a conventional second segment.

Figure 10:
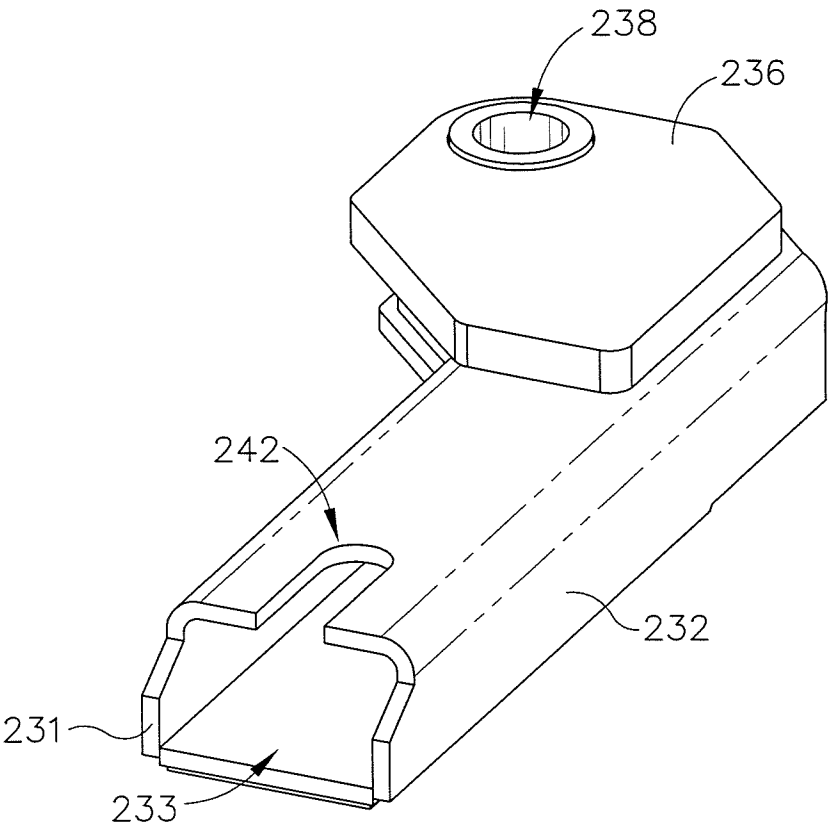
FIG. 10 depicts a top perspective view of a first segment of the second arm of FIG. 7.
Figure 11:
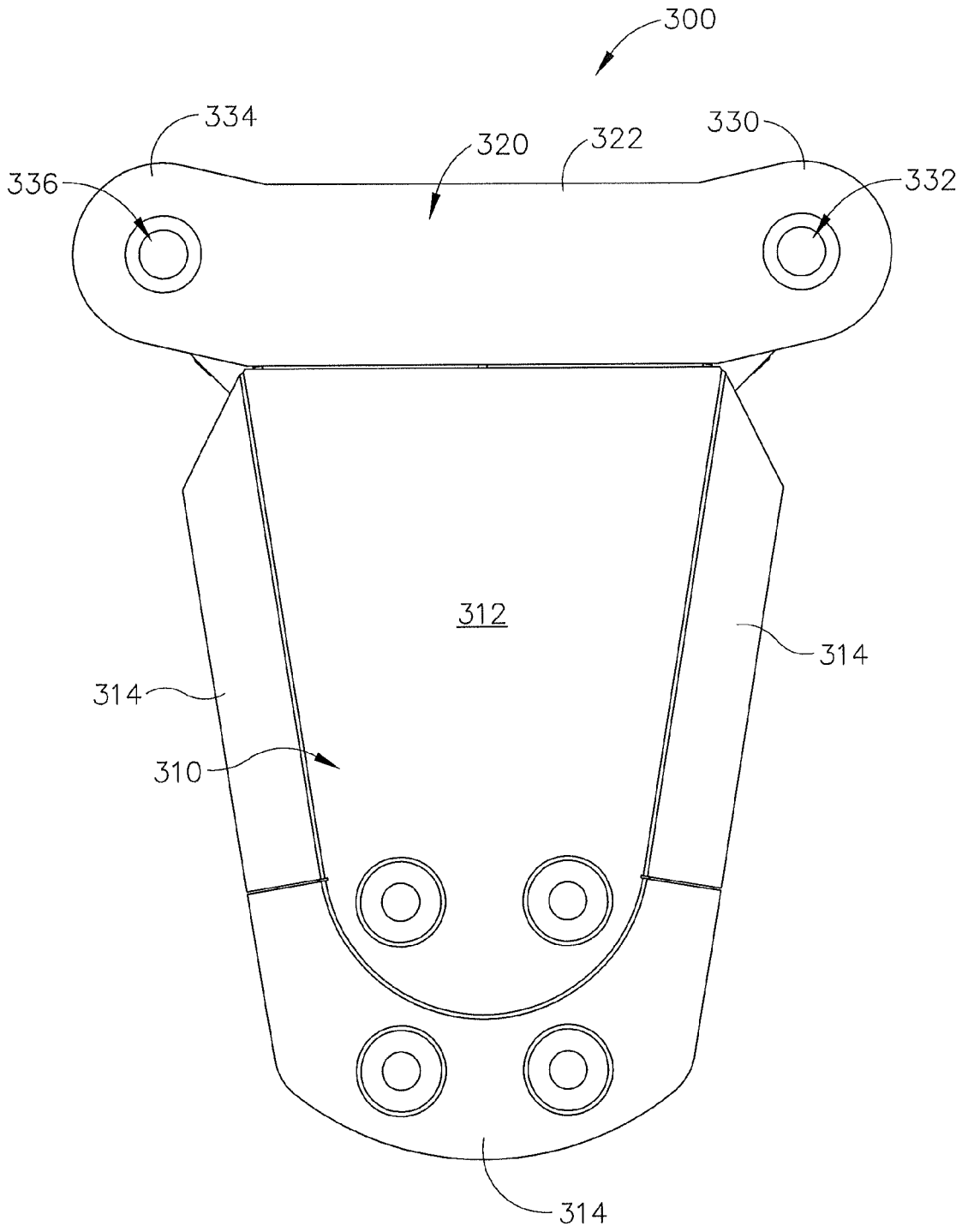
FIG. 11 depicts a top plan view of an exemplary alternative superstructure that may be used with the vehicle lift system of FIG. 1 and the first and second arms of FIGS. 3 and 7.
Figure 12:
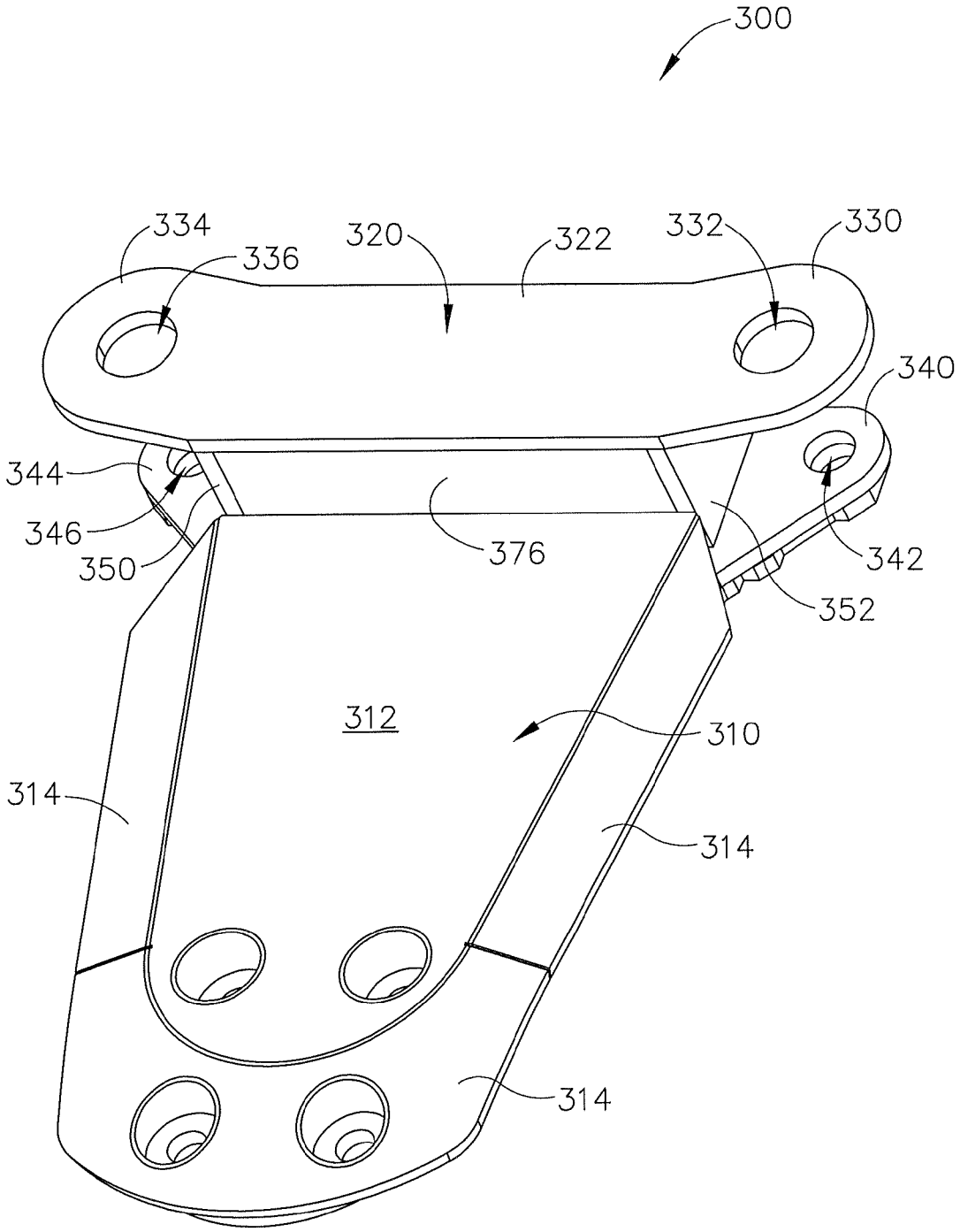
FIG. 12 depicts a top perspective view of the superstructure of FIG. 11.

FIGS. 7-10 show second arm (230) of the present example. Second arm (230) comprises a first segment (232) and a second segment (234). First segment (232) has a distal end (231) and a proximal end (233). Second segment (234) has a distal end (235) and a proximal end (not shown). Second segment (234) telescopically extends from first segment (232), such that the effective length of second arm (230) may be selectively varied. In particular, and as shown in FIG. 10, first segment (232) defines a hollow interior (233) that is configured to receive second segment (234). In FIGS. 7-10, second segment (234) is shown in an extended position where the proximal end of second segment (234) is located within first segment (232). In some versions, second segment (234) may be retracted relative to first segment (232) to such a degree that the proximal end of second segment (234) protrudes proximally from proximal end (233) of first segment (232). Second arm (230) may further be configured such that the longitudinal position of second segment (234) relative to first segment (232) may be selectively locked once second segment (234) has been translated relative to first segment (232) to a desired longitudinal position. Various suitable ways in which such selective locking may be provided will be apparent to those of ordinary skill in the art in view of the teachings herein. In some versions, a locking mechanism or feature is omitted. For instance, in some versions, friction may substantially maintain an adjusted longitudinal positioning of second segment (234) relative to first segment (232). In other words, the mass and/or other properties of segments (232, 234) may permit a user to slide second segment (234) relative to first segment (232) to achieve an adjusted positioning; for the user to then release second segment (234); and for second segment (234) to substantially remain in the adjusted position until the user again manipulates second segment (234) for further adjustment.

First segment (234) also includes a mounting portion (236). Mounting portion (236) provides a coupling with superstructure (300) as will be described in greater detail below. Mounting portion (236) includes a pair of aligned openings (238), which are configured to receive a pin (32) to provide pivoting coupling of second arm (230) with superstructure (300).

Second segment (234) is hollow and has an adapter pilot (400) slidingly disposed therein. In the present example, adapter pilot (400) of second arm (230) is substantially identical to adapter pilot (400) of first arm (130) as described above. Second segment further (234) includes a slot (240). First segment (232) also includes a slot (242), which is substantially aligned with slot (240). Slots (240, 242) facilitate selective positioning of an adapter pilot (400) along the length of second arm (230). In the present example, when adapter pilot (400) is disposed in second arm (230), lower flange (410) is positioned within a hollow interior defined by second segment (234) while an accessory (500, 600) that is secured to adapter pilot (400) is positioned above the top surface of second segment (234), with shaft (520, 620) of accessory (500, 600) passing through slot (240). With accessory (500, 600) being exposed above second segment (234), accessory (500, 600) may be used to directly contact a vehicle for raising the vehicle. As noted above, adapter pilot (400) resides within second segment (234) in some versions and receives various types of accessories based on an operator's selection, without adapter pilot (400) having to necessarily be removed from second segment (234).

Upwardly extending outer sidewall (420) of adapter pilot (400) and slot (240) are sized and configured such that adapter pilot (400) may be translated to various positions along the length of slot (240). Such translatability of adapter pilot (400) relative to the length of second segment (234) thus provides flexibility in placing accessory (500, 600) at a desired lift point under a vehicle. In other words, the translatability of adapter pilot (400) relative to the length of second segment (234) facilitates use of lift (10) with various types of vehicles that are of various sizes. In some versions, an adjusted position of adapter pilot (400) may be selectively locked relative to second segment (234). Various suitable ways in which such selective locking may be provided will be apparent to those of ordinary skill in the art in view of the teachings herein. In some versions, a locking mechanism or feature is omitted. For instance, in some versions, friction may substantially maintain an adjusted longitudinal positioning of adapter pilot (400) relative to second segment (234). In other words, the mass and/or other properties of adapter pilot (400) and second segment (234) may permit a user to slide adapter pilot (400) relative to second segment (234) to achieve an adjusted positioning; for the user to then release adapter pilot (400); and for adapter pilot (400) to substantially remain in the adjusted position until the user again manipulates adapter pilot (400) for further adjustment.

It should also be understood that the translatability of second segment (234) relative to first segment (232) may facilitate use of lift (10) with various types of vehicles that are of various sizes, as such translation of second segment (234) relative to first segment (232) provides even more available positions for top plate (420) of adapter pilot (400) underneath a vehicle. Furthermore, the presence and configuration of slot (242) provides additional clearance for shaft (520, 620) of accessory (500, 600) in settings where second segment (234) is substantially retracted relative to first segment (232) (e.g., where a common vertical axis passes through both slots (240, 242), and where the proximal end of second segment (234) is protruding outwardly relative to proximal end (233) of first segment (232), etc.). In the absence of slot (242), the retractability of second segment (234) relative to first segment (232) may be relatively restricted to a greater degree, as first segment (232) would engage shaft (520, 620) of accessory (500, 600) relatively sooner as second segment (234) is retracted into first segment (232). In the present example, second segment (234) is longer than a conventional second segment yet has at least the same degree of extension and retraction as a conventional second segment.

It should be understood from the foregoing that, due to the presence of an adapter pilot (400) in each second segment (134, 234), and due to the translatability of adapter pilot (400) within each arm (130, 230), each arm (130, 230) may effectively provide adjustability comparable to that of a conventional three-stage/three-segment arm while only having two arm segments (132, 134 and 232, 234) in each arm (130, 230). In other words, each adapter pilot (400) and corresponding slots (140, 142 and 240, 242) may provide an additional degree of movement/adjustability like a third stage/segment in a three-stage/three-segment telescoping arm. In some versions, such functionality may make it relatively easy for a technician to fine tune the position of adapter pilot (400) without having to move second segment (134, 234) relative to first segment (132, 232). It should also be understood that the length of second segment (134, 234) and the length of slot (140, 240) may permit adapter pilot (400) to reach extended positions that would only be reachable in a conventional lift having three stages/segments, with such positions not being reachable in a conventional lift that has only two stages/segments. Furthermore, the configuration of slots (142, 242) may permit adapter pilot (400) to reach retracted positions that would only be reachable in a conventional lift having only two stages/segments, with such positions not being reachable in a conventional lift that has three stages/segments. The above described configuration of arms (130, 230) may also allow for reduction in mass of arms (130, 230), making fine adjustment of second segment (134, 234) relative to first segment (132, 232) relatively easier. Furthermore, the above described configuration of arms (130, 230) may also allow for a lower overall profile for arms (130, 230), making it relatively easier position arms (130, 230) under a low clearance vehicle while the wheels of the vehicle are still on the ground.

III. Exemplary Superstructure

FIGS. 11-16 show superstructure (300) of the present example. Superstructure (300) includes a base portion (310) and a yoke portion (320). Base portion (310) comprises a substantially flat plate (312) that is substantially parallel with the ground, and a plurality of ramps (314) about plate (312). Ramps (314) skirt plate (312) and are angled and configured to provide a substantially smooth transition for a vehicle's wheels as the vehicle drives over base portion (310) when the vehicle is being positioned relative to lift (10). For instance, ramps (314) may be angled in a way that helps a technician center a vehicle on lift (10) (e.g., providing feedback to the driver about the vehicle's lateral position in the bay, etc.). Base portion (310) is configured to be secured to the top of a corresponding post (16), such as by a plurality of bolts and/or in any other suitable fashion.

Yoke portion (320) comprises a top plate (322) and a bottom plate (360). In the present example, and as will be described in greater detail below, bottom plate (360) also extends beneath base portion (310) of superstructure (300). Top plate (322) includes a first upper tongue portion (330) and a second upper tongue portion (334). First upper tongue portion (330) includes an opening (332) that is sized to receive a pin (32). Second upper tongue portion (334) also includes an opening (336) that is sized to receive a pin (32). A first lower tongue portion (340) is positioned directly below first upper tongue portion (330). Similarly, a second lower tongue portion (344) is positioned directly below second upper tongue portion (334). First lower tongue portion (340) includes an opening (342) that is substantially aligned with opening (332) and that is configured to receive pin (32). Second lower tongue portion (340) includes an opening (346) that is substantially aligned with opening (336) and that is configured to receive pin (32).

As noted above, mounting portions (136, 236) of arms (130, 230) may be coupled with superstructure (300). For instance, mounting portion (136) of first arm (130) may be positioned between tongue portions (334, 344), such that openings (138, 336, 346) are all substantially aligned. A pin (32) may then be inserted through openings (138, 336, 346), such that first arm (130) is pivotally secured to superstructure (300) by pin (32). In some other versions, tongue portions (334, 344) are positioned between a pair of mounting portions (136) of first arm (130) to substantially align openings (138, 336, 346) for receipt of a pin (32). Various other suitable ways in which first arm (130) may be coupled with superstructure (300) will be apparent to those of ordinary skill in the art in view of the teachings herein. In the present example, mounting portion (236) of second arm (230) may be positioned between tongue portions (330, 340), such that openings (238, 332, 342) are all substantially aligned. A pin (32) may then be inserted through openings (238, 332, 342), such that second arm (230) is pivotally secured to superstructure (300) by pin (32). Of course, tongue portions (330, 340) may instead be positioned between a pair of mounting portions (236) of second arm (230) to substantially align openings (238, 332, 342) for receipt of a pin (32). Various other suitable ways in which second arm (230) may be coupled with superstructure (300) will be apparent to those of ordinary skill in the art in view of the teachings herein. As one merely illustrative alternative, mounting portion (136) of first arm (130) may instead be coupled with tongue portions (330, 340); while second arm (230) is coupled with tongue portions (334, 344).

Figure 13:
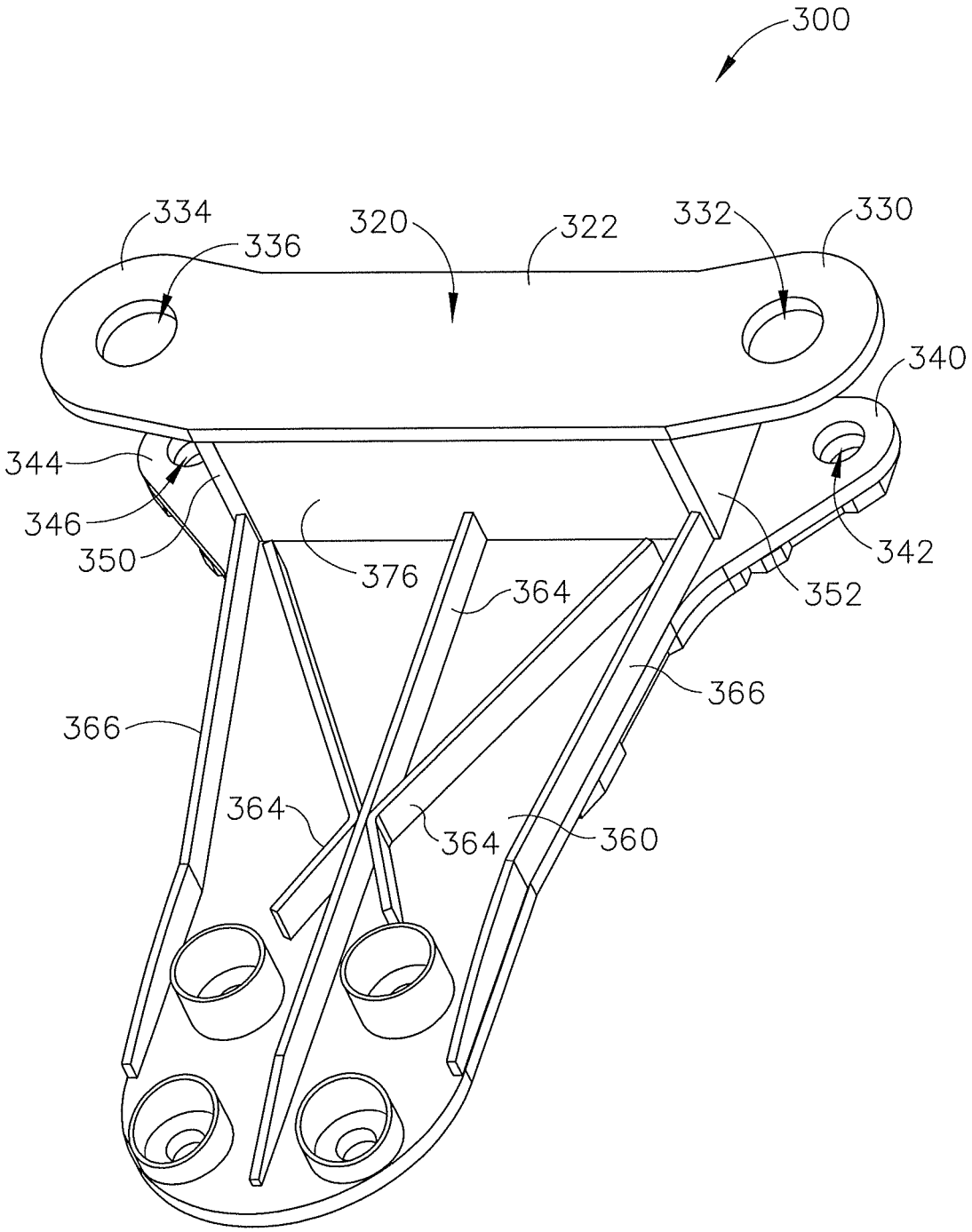
FIG. 13 depicts a top perspective view of the superstructure of FIG. 11, with an upper plate removed.
Figure 15:
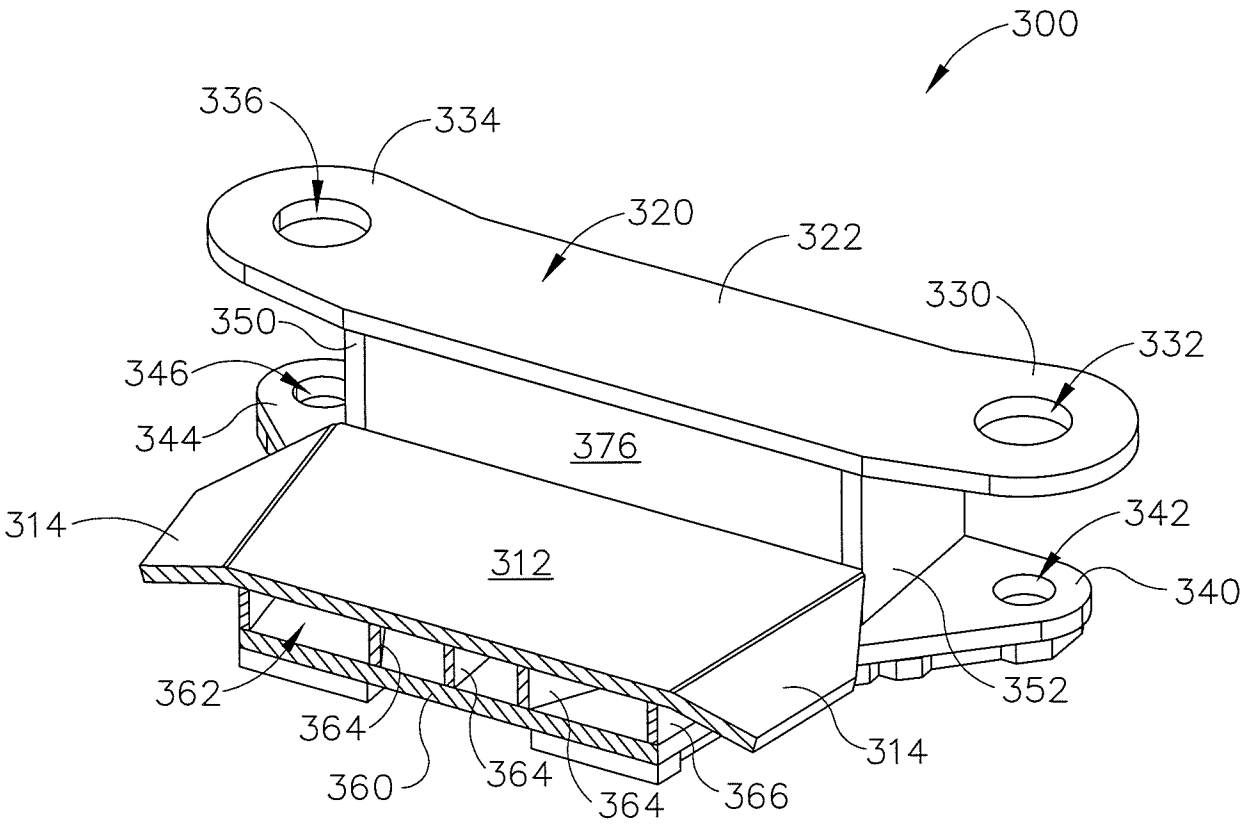
FIG. 15 depicts a top perspective view of the superstructure of FIG. 11, with part of the superstructure in cross-section taken along line 15-15 of FIG. 14.

As can be seen in FIG. 15, plate (312) of base portion (310) is spaced away from bottom plate (360), such that plate (312) and bottom plate (360) together define a hollow interior (362). A plurality of vertical webs (364) extend along the central region of this hollow interior (362), providing structural reinforcement. For instance, vertical webs (364) and/or other internal support structure(s) of superstructure (300) may minimize the impact of torsion to superstructure (300) (e.g., by substantially preventing buckling, twisting, deflection, etc., in base portion (310), etc. when an unbalanced load is placed on superstructure (300)). As best seen in FIG. 13, in which plate (312) is removed, vertical webs (364) include a substantially straight web and a pair of angled webs. As can also be seen in FIG. 13, a pair of outer webs (366) extend upwardly from bottom plate (360) and thereby provide additional support to plate (312). It should be understood that webs (364, 366) may be provided in any other suitable number and/or configuration (e.g., parallel ribs, square matrix configuration, honeycomb configuration, etc.).

Figure 4:
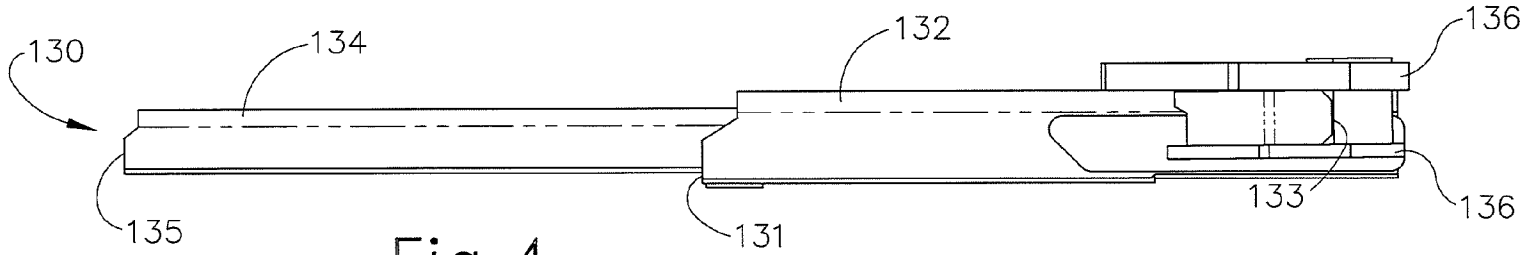
FIG. 4 depicts a side elevation view of the first arm of FIG. 3.
Figure 5:
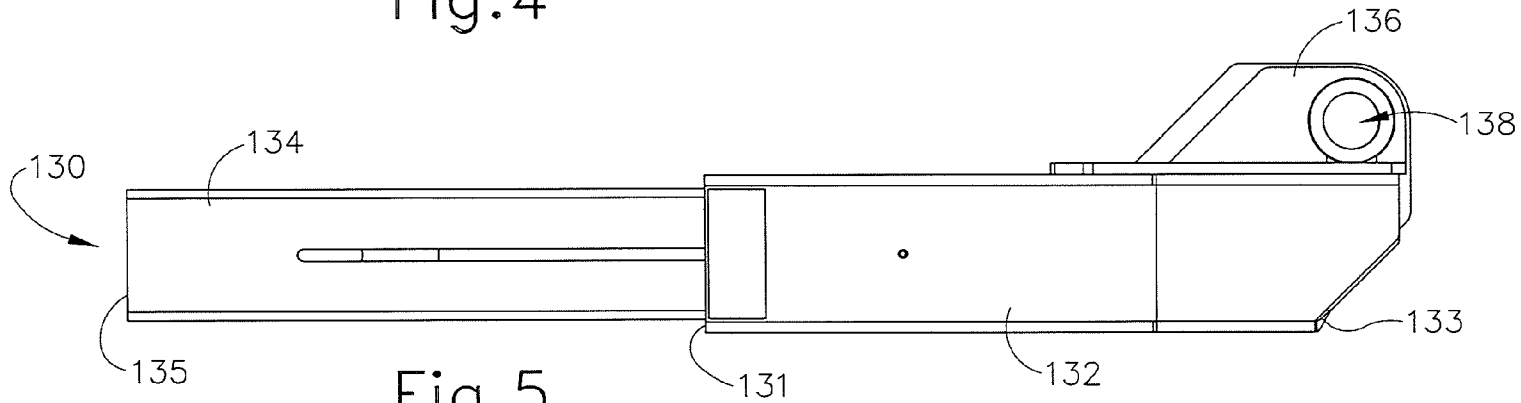
FIG. 5 depicts a bottom plan view of the first arm of FIG. 3.
Figure 8:
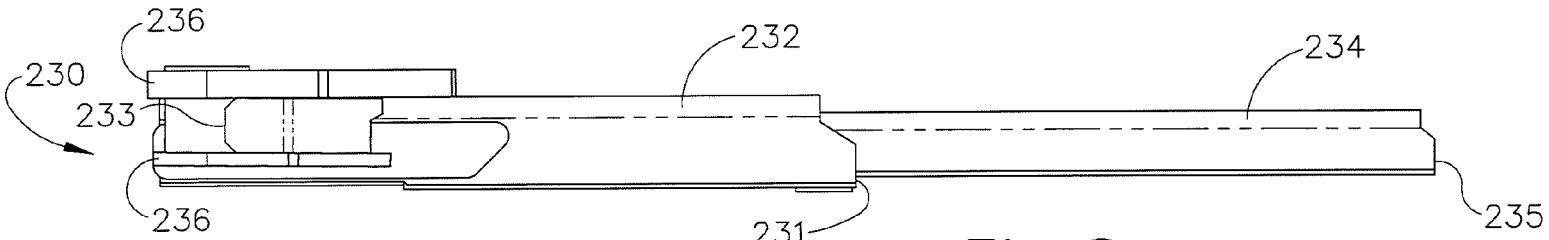
FIG. 8 depicts a side elevation view of the second arm of FIG. 7.
Figure 9:
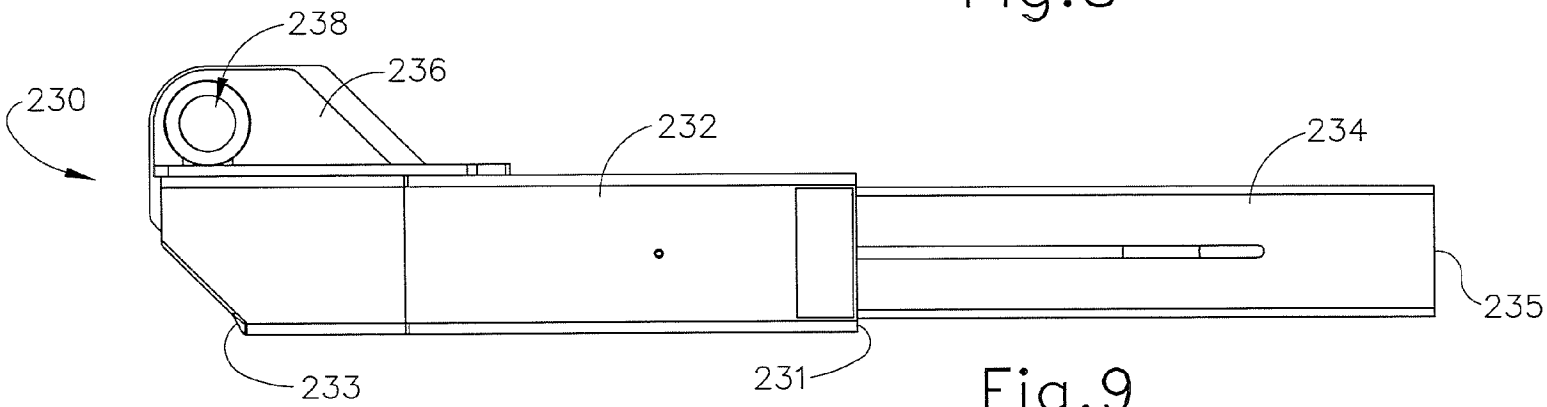
FIG. 9 depicts a bottom plan view of the second arm of FIG. 7.
Figure 14:
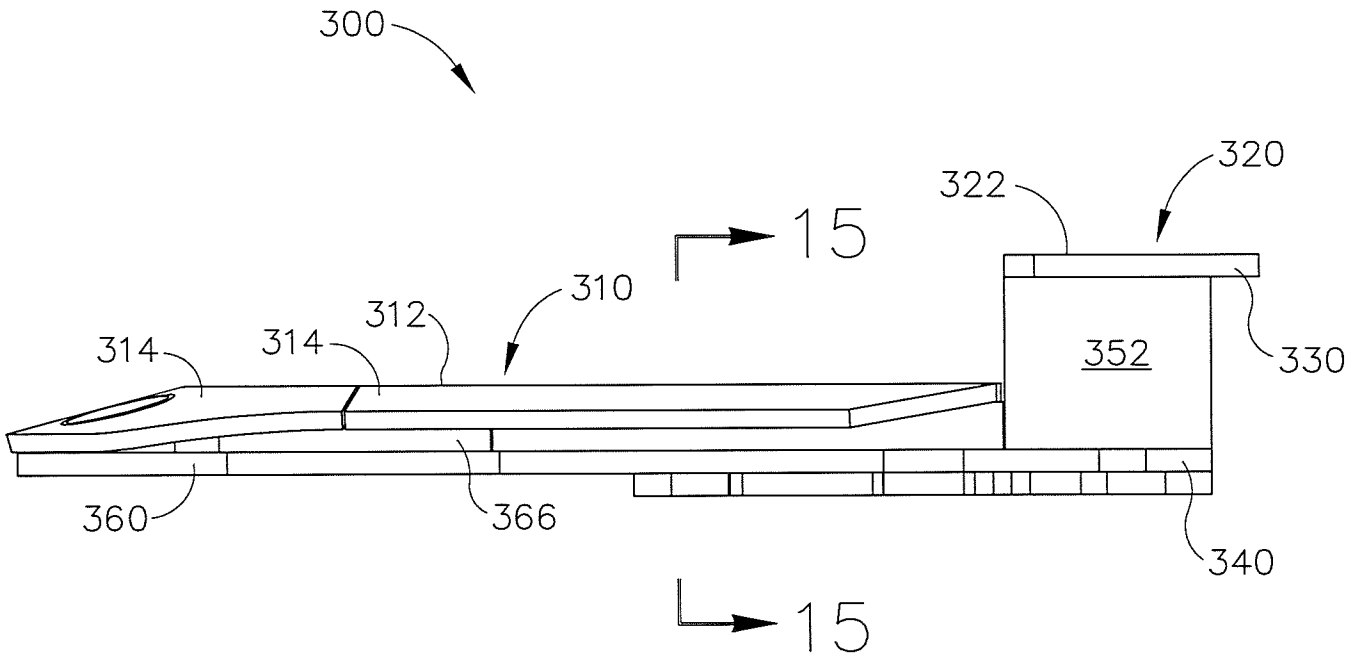
FIG. 14 depicts a side elevation view of the superstructure of FIG. 11.

As can be seen in FIG. 14, base portion (310) presents a substantially low profile. This substantially low profile may allow a relatively wide variety of vehicles to drive over base portion (310) for positioning the vehicle relative to lift (10). In particular, various types of low ground clearance vehicles may drive over base portion (310) without "bottoming out," scraping against, being damaged by, etc., base portion (310). Similarly, as can be seen in FIGS. 4 and 8, arms (130, 230) also present a relatively low profile, which may facilitate positioning arms (130, 230) underneath a relatively low ground clearance vehicle. It should therefore be understood that, in some versions, a lift (10) having superstructure (300) and arms (130, 230) may more easily accommodate low ground clearance vehicles than a lift with conventional superstructures (20) and arms (30) would. For instance, in some versions, a lift (10) having superstructure (300) and arms (130, 230) may be fitted with a vehicle lifting adapter on arms (130, 230) that presents a height not exceeding approximately four inches. In other words, in some versions, when posts (16) are retracted in the ground, the maximum adapter height is no greater than approximately four inches. The cropped or graduated width configuration of base portion (310) may further facilitate access for technicians to certain areas under a vehicle. The improved under-vehicle access may also facilitate removal of items such as under-vehicle covers.

Figure 16:
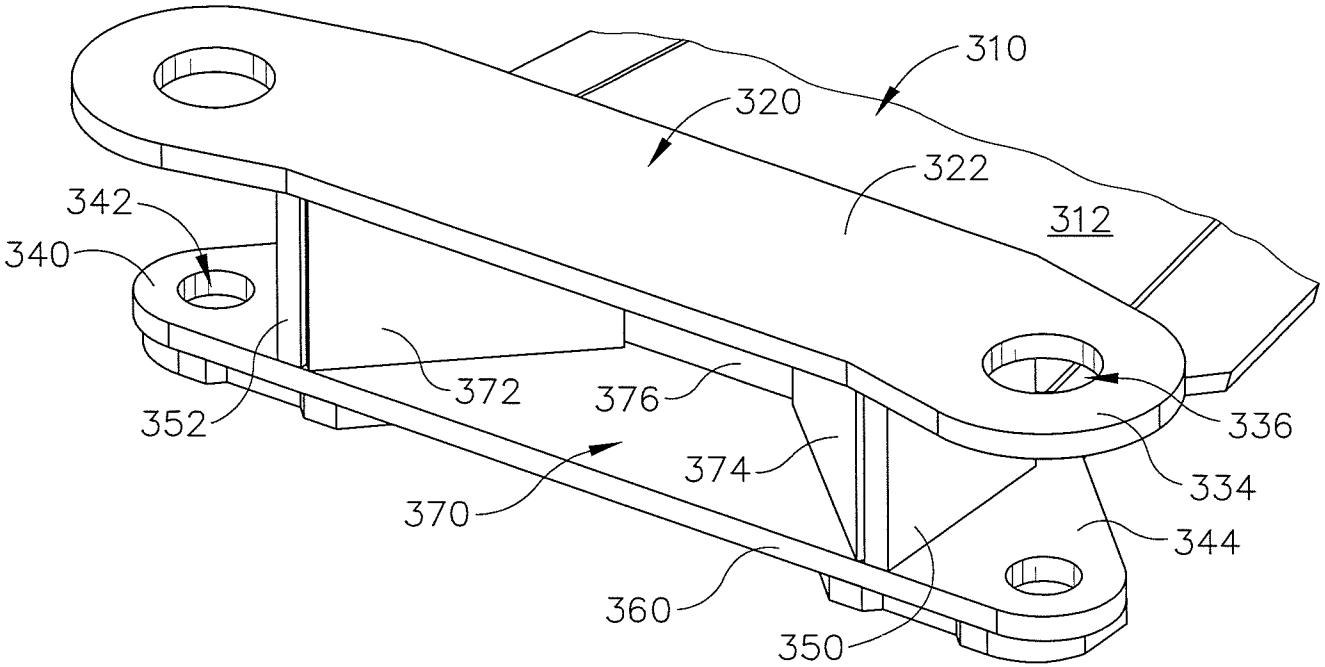
FIG. 16 depicts a partial perspective rear view of the superstructure of FIG. 11.
Figure 17B:
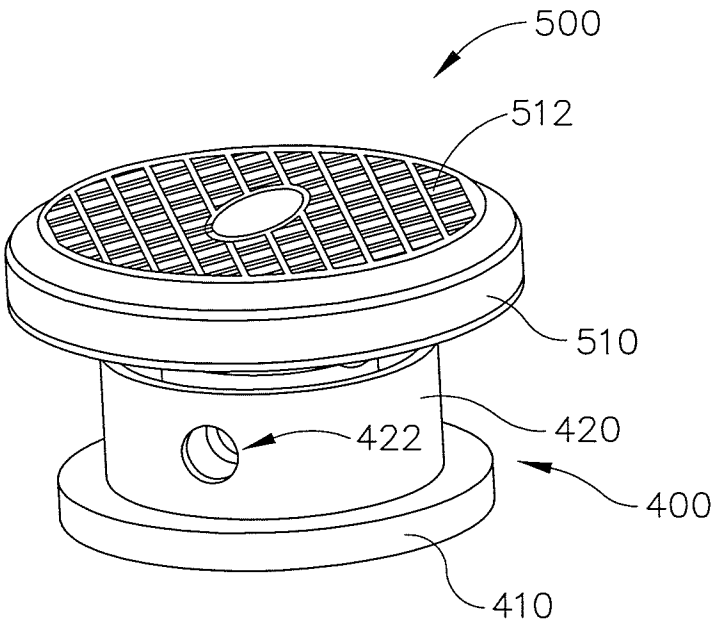
FIG. 17B depicts a perspective view of the adapter pilot and support pad of FIG. 17A coupled together.
Figure 17A:
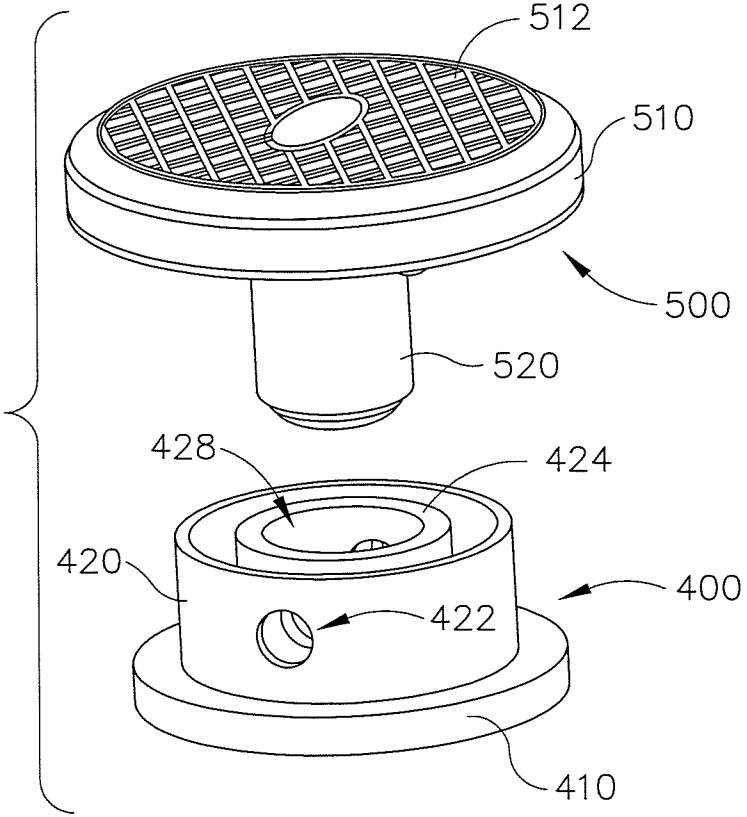
FIG. 17A depicts a perspective view of an exemplary adapter pilot that may be used with the first and second arms of FIGS. 3 and 7, with a vehicle support pad separated from the adapter pilot.

As can be seen in FIGS. 12-16, a plurality of vertical walls (350, 352, 372, 374, 376) extend vertically between substantially horizontal top plate (322) and bottom plate (360). In the present example, vertical walls (350, 352) are substantially parallel with each other, while vertical wall (376) is substantially perpendicular to vertical walls (350, 352). By contrast, vertical walls (372, 374) are each at an oblique angle relative to vertical wall (376) and relative to vertical walls (350, 352). As best seen in FIG. 16, this configuration of vertical walls (372, 374, 376) defines a storage space (370) in the back side of yoke portion (320). It should be understood that storage space (370) may be used to at least temporarily store lug nuts, other loose items, and/or other types of objects.

Superstructure (300) may be formed of laser-cut plates having a thickness of ½ inch or less. Alternatively, superstructure (300) may be formed of any other suitable materials in any suitable fashion.

In some versions, where a lift (10) has a pair of superstructures (300), the distance between superstructures (300) may be greater than the distance that would otherwise be provided between conventional superstructures (300). It should be understood that such an increased distance between superstructures (300) may further provide better access for technicians to components underneath a vehicle.

While superstructure (300) and arms (130, 230) have been described above as being usable with a two-post in-ground lift system, it should be understood that superstructure (300) and/or arms (130, 230) may be used in a variety of other types of lift systems. For instance, superstructure (300) may be readily modified for use in a one-post in-ground lift system. As another merely illustrative example, superstructure (300) may be readily modified for use in a two-post above-ground lift system. For instance, a two-post above-ground lift system may include a carriage on each post with a hydraulic mechanism or other type of mechanism to selectively raise/lower the carriages along the posts, and a superstructure (300) may be secured to each such carriage, such that the carriage and the superstructure (300) together define a vehicle carrier (or such that the superstructure (300) may itself be secured to the post and be regarded itself as a vehicle carrier, etc.). As yet another merely illustrative example, the lift systems taught in any of the patents cited herein may be readily modified to include superstructure (300) and/or arms (130, 230). Various other suitable types of lift systems in which superstructure (300) and/or arms (130, 230) may be incorporated will be apparent to those of ordinary skill in the art in view of the teachings herein. Likewise, various suitable ways in which superstructure (300) and/or arms (130, 230) may be incorporated into various types of lift systems will be apparent to those of ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

We claim:

1. A vehicle lift, comprising:

(a) a vehicle carrier operable to selectively raise and lower relative to the ground to selectively raise and lower a vehicle relative to the ground; and (b) a pair of arms pivotally coupled with the vehicle carrier, wherein each arm of the pair of arms comprises:

(i) a first arm segment pivotally coupled with the vehicle carrier, (ii) a second arm segment slidably disposed relative to the first arm segment, wherein the second arm segment has a first end and a second end, wherein the second arm segment comprises an elongate slot formed in a sidewall of the second arm segment along a length of the second arm segment, wherein the first and second arm segments extend along a longitudinal axis, wherein the first and second arm segments are in telescoping relationship with each other such that the first and second arm segments are configured to telescope along the longitudinal axis, and (iii) an adapter pilot coupled with the second arm segment, wherein the adapter pilot comprises a transversely extending portion that extends transversely through the elongate slot of the second arm segment along a path that is transverse to the longitudinal axis, wherein the transversely extending portion is slidable between the first end and the second end of the second arm segment, wherein the adapter pilot is configured to couple with an accessory to contact the vehicle to allow the vehicle carrier to raise the vehicle.

2. The vehicle lift of claim 1, wherein the vehicle carrier comprises a superstructure, the superstructure comprising:

(i) a first substantially horizontal plate, (ii) a second substantially horizontal plate, (iii) at least one substantially vertical web between the first and second substantially horizontal plates; and (iv) a plurality of ramps skirting the first substantially horizontal plate.

3. The vehicle lift of claim 1, further comprising a vertical lift post, wherein the vehicle carrier is vertically movable along the lift post.

4. The vehicle lift of claim 1, wherein the adapter pilot includes a lower flange and a cylindraceous sidewall extending upwardly from the lower flange, wherein the elongate slot of the second arm segment is associated with the cylindraceous sidewall, wherein the lower flange is disposed within the second arm.

5. The vehicle lift of claim 4, wherein the first arm segment includes an elongate slot associated with the elongate slot of the second arm segment.

6. The vehicle lift of claim 5, wherein the second arm segment is movable relative to the first arm segment between a first translational position and a second translational position, wherein the elongate slot of the first arm segment overlaps with part of the elongate slot of the second arm segment when the second arm segment is in the first translational position, wherein the elongate slot of the first arm segment is longitudinally spaced apart from the entire elongate slot of the second arm segment when the second arm segment is in the second translational position.

7. The vehicle lift of claim 4, wherein the cylindraceous sidewall is disposed through the elongate slot of the second arm segment.

8. The vehicle lift of claim 7, wherein the first arm segment includes an elongate slot, wherein the second arm segment and the adapter pilot are both movable to a configuration where the cylindraceous sidewall is disposed through both the elongate slot of the second arm segment and the elongate slot of the first arm segment.

9. A vehicle lift, comprising:

(a) a vehicle carrier operable to selectively raise and lower relative to the ground to selectively raise and lower a vehicle relative to the ground; and (b) a pair of arms pivotally coupled with the vehicle carrier, wherein each arm of the pair of arms comprises:

(i) a first arm segment, wherein the first arm segment has a first end and a second end which define a longitudinal length of the first arm segment, wherein the first arm segment is pivotally coupled with the vehicle carrier, (ii) a second arm segment slidably disposed relative to the first arm segment, wherein the second arm segment has a first end and a second end which define a longitudinal length of the second arm segment, wherein the second arm segment includes a longitudinal slot formed in a sidewall of the second arm segment between the first end and the second end, wherein the longitudinal slot extends longitudinally along a portion of the longitudinal length of the second arm segment, wherein the second arm segment is slidable relative to the first arm segment, and (iii) an adapter pilot coupled with the second arm, wherein the adapter pilot is slidable along at least part of the longitudinal length of the second arm, wherein a portion of the adapter pilot is exposed relative to the second arm segment, wherein the exposed portion of the adapter pilot is configured to couple with an accessory to contact a vehicle to allow the vehicle carrier to raise the vehicle, wherein a portion of the adapter pilot is configured to pass laterally through the longitudinal slot of the second arm segment along a path transverse to a longitudinal axis defined by the second arm segment.

10. The vehicle lift of claim 9, wherein the adapter pilot is slidable relative to the second arm segment along a range of motion between the first end and the second end of the second arm segment.

11. The vehicle lift of claim 10, wherein the longitudinal slot terminates at slot ends positioned between the first and second ends of the second arm segment, wherein the range of motion of the adapter pilot is provided by the longitudinal slot.

12. The vehicle lift of claim 9, wherein the second arm segment is slidable relative to the first arm segment between a first position and a second position;

wherein the first end of the second arm segment is between the first and second ends of the first arm segment and the second end of the second arm segment is distal to the second end of the first arm segment when the second arm segment is in the first position;

wherein the first end of the second arm segment is proximal to the first end of the first arm segment when the second arm segment is in the second position.

13. The vehicle lift of claim 9, wherein the vehicle carrier comprises a yoke portion, wherein the yoke portion comprises a first pair of tongues and a second pair of tongues, wherein each pair of tongues is configured to couple with a respective arm of the pair of arms.

14. The vehicle lift of claim 13, wherein the first arm segment comprises a mounting portion, wherein the mounting portion comprises an upper plate and a lower plate, wherein the upper plate and lower plate are positioned between the tongues of the corresponding pair of tongues.

15. A vehicle lift, comprising:

(a) a vehicle lift post;

(b) a superstructure secured to the vehicle lift post, wherein the superstructure is operable to selectively raise and lower relative to the ground to selectively raise and lower a vehicle relative to the ground, wherein the superstructure comprises:

(i) a first substantially horizontal plate, (ii) a second substantially horizontal plate, (iii) at least one substantially vertical web between the first and second substantially horizontal plates, and (iv) a yoke portion, wherein the yoke portion includes a recessed area sized and configured to receive and store vehicle parts, wherein the first and second substantially horizontal plates and the at least one substantially vertical web together present a profile low enough to provide passage of a low clearance vehicle thereover, wherein the first and second substantially horizontal plates each extend along respective plate lengths, wherein the at least one substantially vertical web comprises a first web extending along a length that is substantially parallel to the plate lengths, a second web extending along a length that is skewed relative to the plate lengths, and a third web extending along a length that is skewed relative to the plate lengths; and (c) a pair of arms secured to the yoke portion, wherein the pair of arms are configured to engage the vehicle, and wherein the recessed area is defined in a side of the superstructure opposite of a side along which the pair of arms rotate.

16. The vehicle lift of claim 15, wherein the vehicle lift post is selectively movable relative to the ground along a substantially vertical dimension, such that the vehicle lift post is selectively extendable and retractable relative to the ground.

17. The vehicle lift of claim 15, wherein the superstructure is translatable along the vehicle lift post.

18. The vehicle lift of claim 15, wherein the yoke portion comprises a first pair of tongues and a second pair of tongues, wherein a first arm of the pair of arms is pivotally secured to the first pair of tongues, wherein a second arm of the pair of arms is pivotally secured to the second pair of tongues.

* * * * *